United States Patent [19]

Kwasnik et al.

[11] 4,347,105

[45] Aug. 31, 1982

[54] COKE SIDE GANTRY CAR FOR A BATTERY OF COKE OVENS

[75] Inventors: Hans-Jurgen Kwasnik, Herne; Hans-Gunter Piduch, Bochum, both of Fed. Rep. of Germany

[73] Assignee: Dr. C. Otto & Comp. G.m.b.H., Bochum, Fed. Rep. of Germany

[21] Appl. No.: 205,893

[22] Filed: Nov. 12, 1980

[51] Int. Cl.[3] ..... C10B 5/00

[52] U.S. Cl. ..... 202/263; 202/269; 202/262

[58] Field of Search ..... 202/262, 263, 269

[56] References Cited

U.S. PATENT DOCUMENTS

| | | | |
|---|---|---|---|
| 3,616,946 | 11/1971 | Linnerz et al. | 202/262 |
| 3,817,840 | 6/1974 | Stender | 202/262 |
| 3,839,161 | 10/1974 | Pries | 202/263 |
| 3,928,144 | 12/1975 | Jakimowicz | 202/262 |
| 4,113,572 | 9/1978 | Manda et al. | 202/263 |
| 4,211,608 | 7/1980 | Kwasnoski | 202/263 |

*Primary Examiner*—Norman Yudkoff

*Attorney, Agent, or Firm*—Thomas H. Murray; Clifford A. Poff

[57] ABSTRACT

A coke side gantry car for a battery of coke ovens supports an extractor and a cleaner for the door, a door frame cleaner, a coke guide grating and a hood for collecting emissions during coke pushing operations. At least one of a plurality of rails to support the gantry car is disposed on the coke platform and another of the rails is disposed outwardly therefrom above and generally parallel with tracks for a hot coke car. A coke guide grating in a casing with continuous side walls moves axially of the oven chamber between the chamber opening and an outward position where a substantial part of the weight is carried by the outer track for the gantry car. The casing extends around the grating and covers the side walls thereof. The casing cooperates with members to form a seal with the coke oven chamber and the smoke hood.

3 Claims, 4 Drawing Figures

COKE SIDE GANTRY CAR FOR A BATTERY OF COKE OVENS

BACKGROUND OF THE INVENTION

This invention relates to a gantry car to move along the coke side of a battery of horizontal coke ovens and carry a coke oven door extractor, a coke oven door frame cleaner, a coke oven frame cleaner, a coke guide grating and a hood for collecting the emissions evolved during the pushing of coke from an oven chamber. More particularly, the present invention relates to such a car to more efficiently support such equipment thereon and insure that emissions to the atmosphere do not occur during coke pushing operations.

A coke side gantry car of this type should remain at the same or a fixed position in front of an oven chamber which is to be emptied throughout the time while the various operations are carried out by the use of equipment supported on the car. These operations include the extraction of the coke oven door and movement to one side of an oven chamber, pushing of the coke through a guide into a hot coke car, cleaning the door frame, cleaning the coke oven door and replacing the door on the coke oven chamber. When the car is employed in this manner, it is identified as a one-point car, an embodiment of which includes, inter alia, a frame movable longitudinally on the car and supporting the various individual facilities for use incident to coke discharging operations. Specifically, for example, the movable frame supports an extractor to remove the door from a coke oven chamber, a guide grating to direct hot coke from the oven chamber into a hot coke car and a cleaner device to remove encrusted deposits on the frame of the coke oven chamber. These devices are supported on the frame one after the other for movement one after the other to various positions in which operation by each facility is carried out. The various pieces of equipment, including the grating for guiding coke, are so heavy that it is difficult to accurately position the frame on the car because of the weight that must be moved while the car remains at a stationary location. These problems have increased significantly because the present-day coke oven batteries have oven chambers with a relatively great height. As a result, the equipment supported by a one-point car for use during a coke pushing operation imposes greater weight on the frame and tracks on the one-point car. This brings about an excessive loading of the coke platform because of its use as a support structure. Moreover, when the coke oven door extractor is operated, an additional force must be developed to release the usual plug on the oven door from the coke cake in the oven chamber. When the car is provided with a hood above the hot coke car, then further problems arise when developing a coke guide grating to operate without emissions to the atmosphere during the coke pushing operation. The emissions must be received substantially in their entirety by the hood and delivered to an associated emission extraction system.

It is known to provide a hood and a coke guide grating on a gantry device that moves along rails, one of which is disposed on the coke platform and the other of which is disposed outwardly beyond and above the tracks of the hot coke car.

SUMMARY OF THE INVENTION

It is an object of the present invention to provide a gantry car including a hood designed to receive emissions substantially in their entirety during a coke pushing operation while carrying various other facilities in a manner for simplicity of operation and to provide that the weight imposed by the facilities on the coke platform is not excessive.

According to the present invention, a gantry car takes the form of a car in a known manner to ride along rails disposed one on each side of a hot coke car track but with the gantry car carrying a coke guide grating trough having continuous rigid walls on both sides and movable in a direction of the longitudinal axis of an oven into sealing engagement with the chamber opening on the one hand, and on the other hand, movable outwardly therefrom to an extent such that much of the weight of the trough is received by the other track.

More specifically, according to the present invention, there is provided apparatus to traverse along a platform at the coke side of a coke oven battery in a generally parallel relation therewith and generally parallel with the movement of a hot coke car along tracks below the platform, the apparatus including the combination of a gantry car to move along the coke side of the coke oven battery while supporting a coke oven door extractor, a coke oven door cleaner, a coke oven door frame cleaner, and a hood to collect emissions during pushing of coke from an oven chamber, at least two gantry support rails, one rail being arranged to extend along the platform and the other rail being arranged to extend along outwardly beyond the hot coke car tracks to support the gantry car, a coke guide trough means having continuous rigid side walls for directing hot coke from the oven chamber above the platform into the hot coke car, and means to support the coke guide trough means for movement on the gantry car in an axial direction of a coke oven chamber between the chamber opening and a more distally outward position where the outwardly-arranged one of the rails receives a substantial part of the weight of the coke guide trough means.

When a coke guide grating forming part of the coke guide trough means is not in use, the assembly is moved to clear the space near the oven openings for carrying out consecutive operations by the various facilities. These include extracting the door, replacing the door, cleaning the door and cleaning the door frame. The construction of parts of the apparatus of the present invention brings about a considerable reduction to the total weight of the gantry car. During movement of the car, the coke guide grating is positioned at a location where the load imposed on the coke platform remains within tolerable limits.

According to a further feature of the present invention, a casing extends around the coke guide grating such that it covers the side walls and forms a top cover. The casing is open at its rear end portion, i.e., the portion toward the hood, and when the coke guide grating is positioned to conduct coke, a seal is formed by resilient strips that engage with metal surfaces on the coke oven battery. These metal surfaces can be the door frame or the buckstays and their use permits the formation of a seal with an open oven chamber during the coke pushing operation. The hood has a front wall part that extends parallel to the direction of movement by the gantry car. This wall is formed with an opening in which the coke guide grating and the casing extending therearound are guided. The opening in the front hood wall is sealed for all positions of the grating by a resilient peripheral strip.

These features and advantages of the present invention as well as others will be more fully understood when the following description of the preferred embodiment is read in light of the accompanying drawings, in which.

Figure 1:
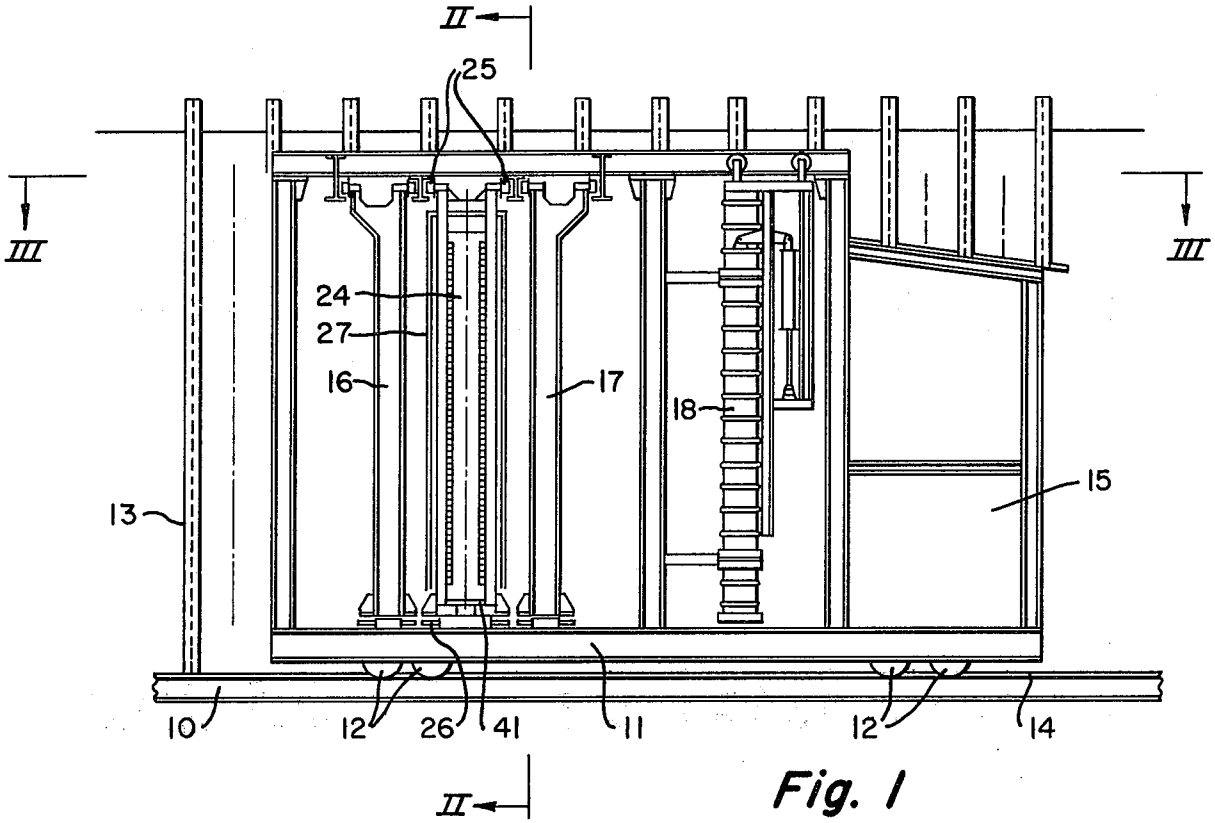
FIG. 1 is a front elevational view of a coke side gantry car as viewed from a battery of coke ovens.
Figure 2:
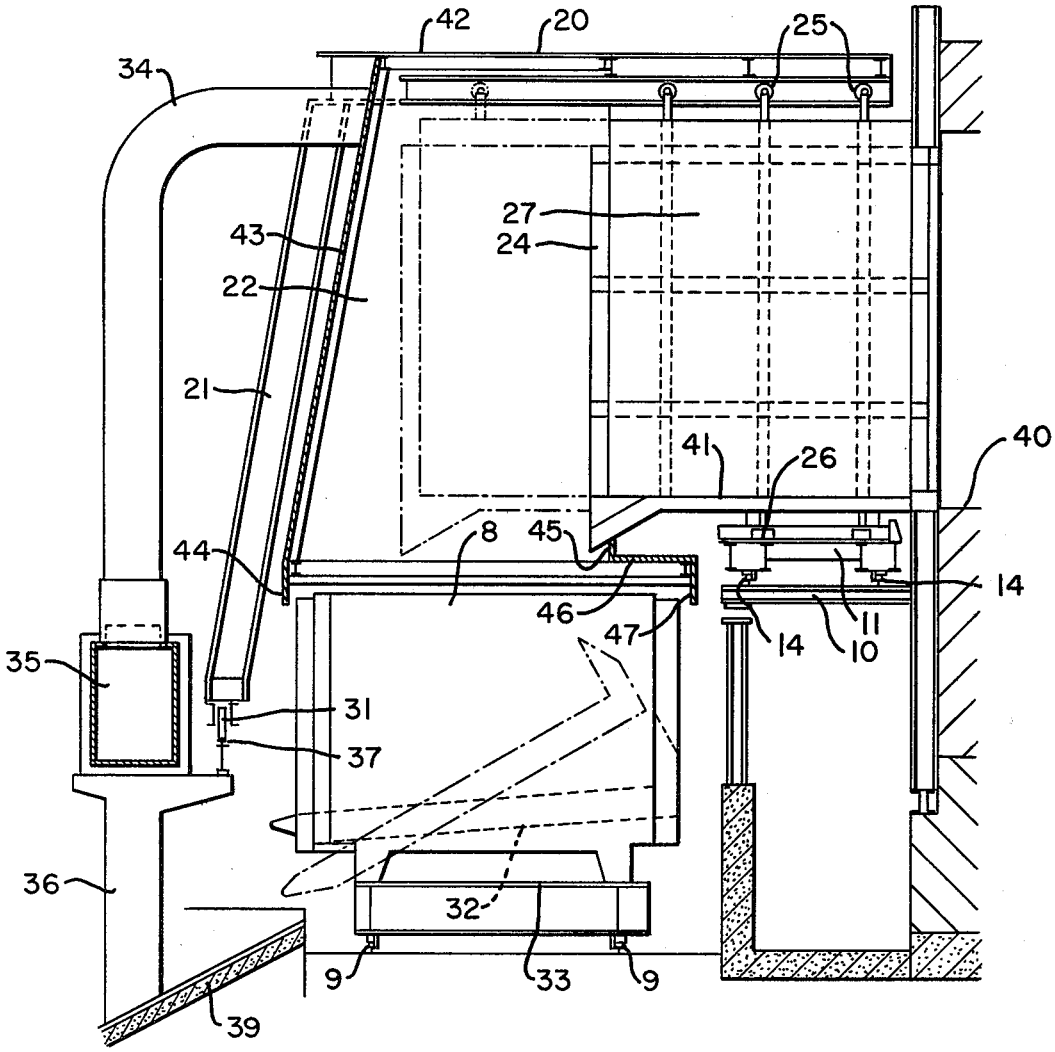
FIG. 2 is a sectional view taken along line II—II of FIG. 1 in which a coke guide grating is moved into a sealed engagement with an oven chamber for a coke pushing operation.
Figure 3:
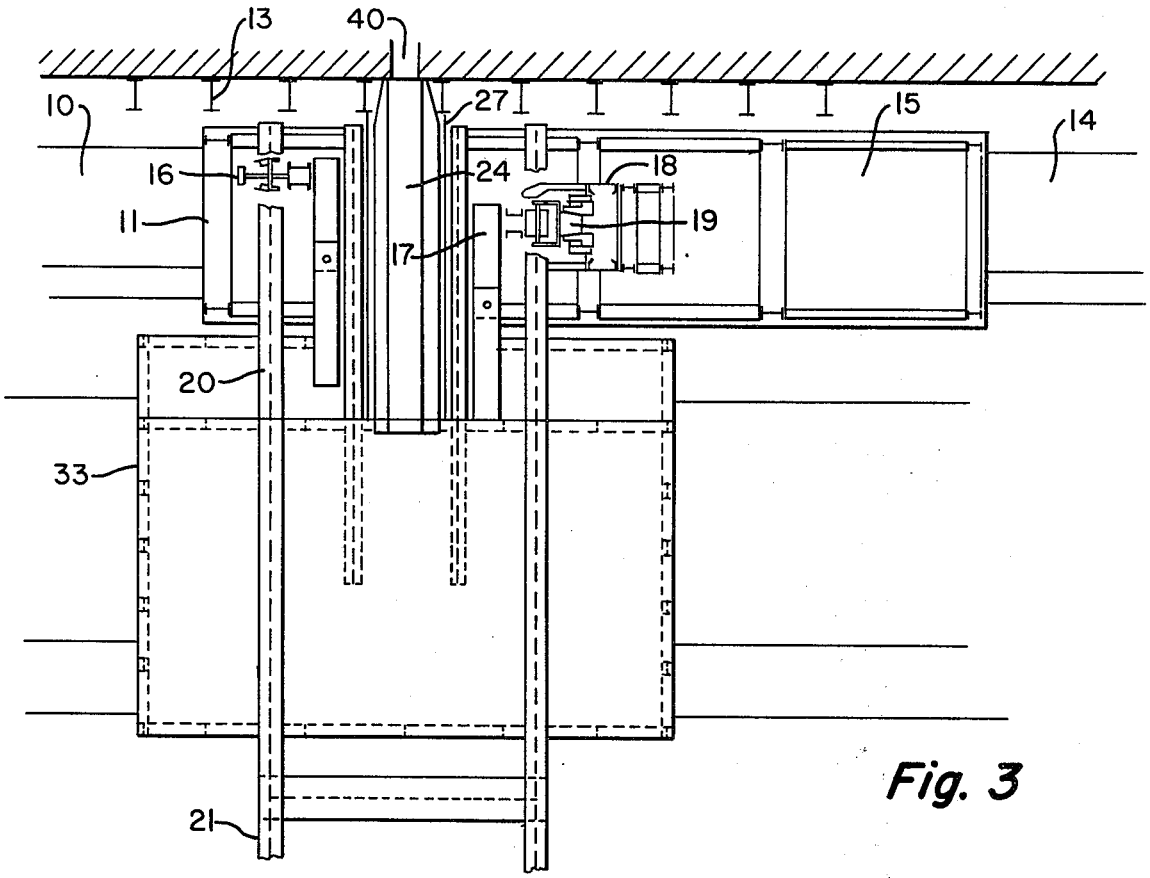
FIG. 3 is a horizontal sectional view taken along line III—III of FIG. 1 with the coke guide grating shown in the position illustrated in FIG. 2.

In FIGS. 1–3, there is illustrated a coke platform 10 that extends along the coke side of a battery of coke oven chambers. Reference numeral 40 identifies one of the coke oven chambers from which coke is pushed. A one-point coke car 33 has walls 8 to receive hot coke and a pivotal bottom 32 for discharging coke into a coke side bench 39. Car 33 moves along a pair of tracks 9 extending along the coke side of the oven battery below the coke platform. A rail 37 and a common waste gas flue 35 extend along the coke oven battery in a generally parallel relation with the tracks 9 but spaced outwardly therefrom in relation to the coke platform 10. Rail 37 and a flue 35 are carried on supports 36.

The coke platform has two spaced-apart rails 14 on which wheel sets 31 of a gantry car 11 engage for support. The gantry car 11 includes horizontal frame members 20 and inclined frame members 21 which are supported by sets of wheel assemblies 31 for movement along rail 37. The gantry car supports a coke oven door frame cleaner 16, a coke oven door extractor 17 and a coke oven door cleaner 18. Also supported by the car 11 is a driver's cab 15. In FIG. 3, a coke oven door is shown while engaged by the coke oven door extractor 17 and positioned before the coke oven door cleaner 18.

Figure 4:
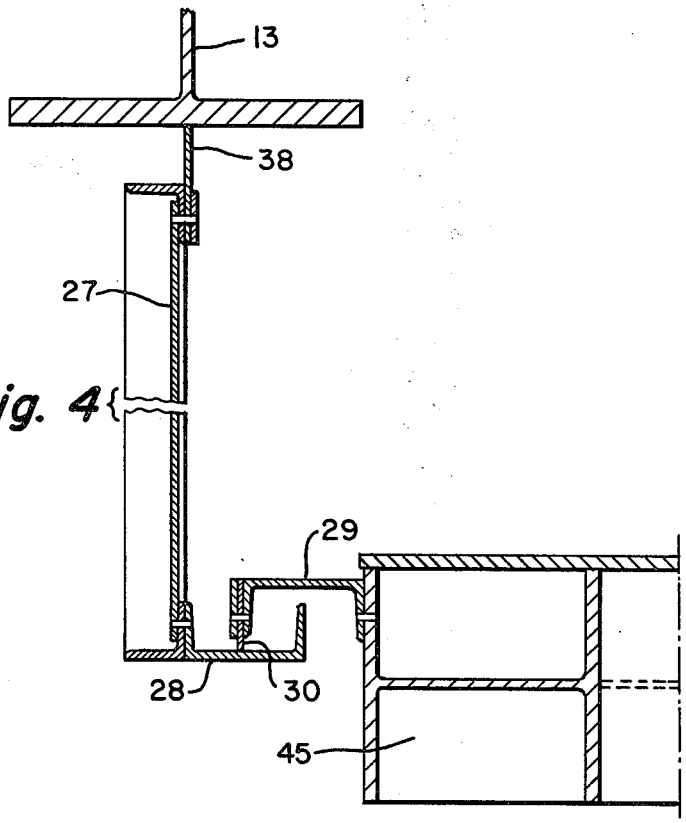
FIG. 4 is an enlarged partial view of the coke guide casing in its operative relation during the pushing of coke from an oven chamber.

As best shown in FIGS. 2 and 3, the gantry car 11 also carries a hood 22. The hood includes a roof 42 and spaced-apart outer side walls 43 which extend in a generally parallel relation to frame members 21 of the gantry car. A bottom end wall 44 extends along one long side of a hot coke car 33. A hood inner wall 45 extends parallel to platform 10. Wall 45 includes members 46 and 47 at the bottom thereof forming an angle, in cross section, to extend along the top and inner side edge parts of the hot coke car 33. Inner wall 45 has a vertical opening facing toward the coke oven battery through which there extends a coke guide grating 24. The coke guide grating has a casing 27 around it and carries a trough which extends to an elevation below the sole of the coke oven chamber but within the hood. Wheels 25 support the grating for movement toward and away from the oven chamber on an overhead rail in the top portion of the car and extending through the wall 45. Rollers 26 guide the grating during movement toward and away from the oven chamber. As best shown in FIG. 4, the front end of casing 27, i.e., the end of the casing facing toward the oven chamber, supports strips 38 for sealing the interior of the casing by engagement with buckstays 13. When desired, strip 38 can be arranged to engage with the usual frame at the end of the coke oven chamber. The opposite and outer end of the casing 27 is provided with a channel section 28 which is moved into cooperative relation with a channel section 29 supported on the outer wall 45 of the hood. A seal 30 is supported by channel section 29 for cooperative engagement with the web part of channel section 28. When the casing 27 is moved into a sealed relation between the buckstays of the oven chamber and the smoke hood, emissions occurring during the coke pushing operation are substantially received in their entirety by the smoke hood. The emissions collected in the smoke hood are conducted by a conduit or tube 34 from the interior of the smoke hood 22 to the common waste gas flue 35. The extended position of the coke guide grating and casing is shown in FIG. 2 and the retracted position is shown by phantom lines.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. Apparatus adapted to traverse along a platform at the coke side of a coke oven battery in a generally parallel relation therewith and generally parallel with movement of a hot coke car along tracks below said platform, said apparatus including the combination of a gantry car to move along the coke side of said coke oven battery, said gantry car supporting a coke oven door extractor, a coke oven door cleaner, a coke oven door frame cleaner, and a hood to collect emissions during pushing of coke from an oven chamber, said hood having a horizontal opening overlying said hot coke car, at least two gantry support rails, one rail being arranged to extend along said platform and the other rail being arranged to extend along outwardly beyond said tracks to support said gantry car for traversing movement, a coke guide grading for directing hot coke from an oven chamber above said platform into said hot coke car, a coke guide casing having continuous rigid side walls enclosing said coke guide grading and spanning the distance between an oven chamber and said hood, means including an overhead rail supported by said gantry car to extend within said hood for suspended support of said coke guide casing and said coke guide grading and for movement thereof on said gantry car in an axial direction of a coke oven chamber in said battery between a coke-guiding position interconnecting the oven chamber opening with said hood and a retracted position where said coke guide casing and said coke guide grading extend into said hood whereby said other rail receives a substantial part of the weight thereof from said gantry car, said hood having an opening through which said coke guide casing and said coke guide grading can move, and seal means between said hood and said coke guide casing in said coke-guiding position, said coke guide grading having an end portion within said hood engaging said horizontal opening in said hood in sealing relation when in the coke-guiding position thereof.

2. The apparatus according to claim 1 further including seal means on said coke guide casing for engaging with the coke oven battery to form a sealed relation with a coke oven chamber thereof.

3. The apparatus according to claim 2 wherein said coke oven battery includes metal surfaces at coke discharge openings of the oven chambers, and wherein said seal means includes resilient strips to engage said metal surfaces.

* * * * *

UNITED STATES PATENT AND TRADEMARK OFFICE

CERTIFICATE OF CORRECTION

PATENT NO. : 4,347,105

DATED : August 31, 1982

INVENTOR(S) : Han-Jurgen Kwasnik et al

It is certified that error appears in the above-identified patent and that said Letters Patent is hereby corrected as shown below:

On the title Insert:

-- Foreign Application Priority Data
November 28, 1979 (DE) Fed. Rep. of Germany 2947859 --.

Signed and Sealed this

*Twenty-first* Day of *December 1982*

[SEAL]

*Attest:*

GERALD J. MOSSINGHOFF

*Attesting Officer*

*Commissioner of Patents and Trademarks*